US011731738B1

(12) United States Patent
Gong et al.

(10) Patent No.: US 11,731,738 B1
(45) Date of Patent: Aug. 22, 2023

(54) AUTOMATIC BERTHING SYSTEM FOR UNMANNED SHIP

(71) Applicants: Ludong University, Yantai (CN); Land Sea Space (Yantai) Information Technology Co., Ltd, Yantai (CN)

(72) Inventors: Qingtao Gong, Yantai (CN); Yao Teng, Yantai (CN); Xin Hu, Yantai (CN); Kangqiang Li, Yantai (CN); Lu Liu, Yantai (CN); Liyan Jin, Yantai (CN); Yanqing Han, Yantai (CN); Zhongyu Sun, Yantai (CN); Ling Zhang, Yantai (CN)

(73) Assignees: Ludong University, Yantai (CN); Land Sea Space (Yantai) Information Technology Co., Ltd, Yantai (CN)

( * ) Notice: Subject to any disclaimer, the term of this patent is extended or adjusted under 35 U.S.C. 154(b) by 0 days.

(21) Appl. No.: 18/072,738

(22) Filed: Dec. 1, 2022

(30) Foreign Application Priority Data

Feb. 4, 2022 (CN) ..... 202210169493.6

(51) Int. Cl.
*B63B 21/00* (2006.01)

(52) U.S. Cl.
CPC ..... *B63B 21/00* (2013.01); *B63B 2021/003* (2013.01)

(58) Field of Classification Search
CPC ..... B63B 21/00; B63B 2021/003
USPC ..... 114/230.1
See application file for complete search history.

(56) References Cited

U.S. PATENT DOCUMENTS 10,427,760 B2 * 10/2019 Ramari ..... B63B 21/20
11,447,208 B2 * 9/2022 Sipilä ..... B63B 21/20

FOREIGN PATENT DOCUMENTS

| | | | |
|---|---|---|---|
| CN | 110667785 | A | 1/2020 |
| CN | 110816753 | A | 2/2020 |
| CN | 210391480 | U | 4/2020 |
| CN | 211663406 | U | 10/2020 |
| CN | 112942252 | A | 6/2021 |
| CN | 113512989 | A | 10/2021 |
| KR | 20110059206 | A | 6/2011 |

* cited by examiner

*Primary Examiner* — Daniel V Venne
(74) *Attorney, Agent, or Firm* — Bayramoglu Law Offices LLC

(57) ABSTRACT

An automatic berthing system for an unmanned ship includes a plurality of roof plates fixedly arranged at a side edge of a shore, and a position adjusting mechanism is fixedly arranged in the roof plate. The position adjusting mechanism includes an X-direction adjusting assembly, a Y-direction adjusting assembly, and a Z-direction adjusting assembly. The X-direction adjusting assembly is fixedly connected to an inner sidewall of a fixing bracket. The fixing bracket is fixedly connected to an inner sidewall of the roof plate. A fixing plate is connected to the inner side of the X-direction adjusting assembly. The Y-direction adjusting assembly is connected to the bottom of the fixing plate. The automatic berthing system can realize accurate berthing of an unmanned ship, achieve an excellent berthing effect, and provide protection for the unmanned ship, achieving high safety.

10 Claims, 7 Drawing Sheets

AUTOMATIC BERTHING SYSTEM FOR UNMANNED SHIP

CROSS REFERENCE TO THE RELATED APPLICATIONS

This application is based upon and claims priority to Chinese Patent Application No. 202210169493.6, filed on Feb. 24, 2022, the entire contents of which are incorporated herein by reference.

TECHNICAL FIELD

The present disclosure belongs to the technical field of berthing devices for unmanned ships and particularly relates to an automatic berthing system for an unmanned ship.

BACKGROUND

Unmanned ships are regarded as fully-automatic robots navigating the waters according to preset tasks using precise satellite positioning and self-sensing instead of being remotely controlled. The marine high-speed unmanned ship "Navigator" independently developed in China is an "intelligent water surface robot" that integrates a variety of high technologies and can be widely used in environmental monitoring, search and rescue, security patrol, and other fields. The "intelligent water surface robot" integrates ships, communication, automation, robot control, remote monitoring, network systems, and other technologies and realizes the functions of autonomous navigation, intelligent obstacle avoidance, long-distance communication, real-time video transmission, network monitoring, and the like.

At present, it is necessary to install a variety of high-end sophisticated electronics on the existing unmanned ship, and the unmanned ship directly stops at the shore in general when berthing. In this case, the high-end sophisticated electronics are likely to be eroded by rain and maliciously damaged by other people, resulting in poor safety. Besides, during berthing, the unmanned ship moves to the shore on its own and is prone to directly colliding with the shore in the case of low berthing accuracy, resulting in a poor berthing effect. After berthing, the unmanned ship needs to be fixedly connected to the shore by a rope and is likely to move back and forth under the impact effect of waves. In this case, it collides with the shore and is further damaged as a consequence. As a result, the service life of the unmanned ship is greatly shortened.

SUMMARY

The objective of the present disclosure is to provide an automatic berthing system for an unmanned ship to solve the problems mentioned in the background art.

To achieve the above objective, the present disclosure adopts the following technical solution. An automatic berthing system for an unmanned ship includes a plurality of roof plates fixedly arranged at a side edge of a shore, and a position adjusting mechanism is fixedly arranged in the roof plate. The position adjusting mechanism includes an X-direction adjusting assembly, a Y-direction adjusting assembly, and a Z-direction adjusting assembly, where the X-direction adjusting assembly is fixedly connected to an inner sidewall of a fixing bracket. The fixing bracket is fixedly connected to an inner sidewall of the roof plate. A fixing plate is connected to the inner side of the X-direction adjusting assembly. The Y-direction adjusting assembly is connected to the bottom of the fixing plate. The Z-direction adjusting assembly is connected to the bottom of the Y-direction adjusting assembly. A connecting plate is fixedly connected to the bottom of the Z-direction adjusting assembly. A spacing adjusting mechanism is arranged on the inner side of the connecting plate. Two flexible connection mechanisms for damping are connected to the spacing adjusting mechanism. A clamping claw mechanism is fixedly connected to an end, away from the connecting plate, of each of the two flexible connection mechanisms for damping.

Preferably, the X-direction adjusting assembly includes a first drive motor fixedly connected to the inner sidewall of the fixing bracket. A first gear is fixedly connected to an output shaft of the first drive motor, and the first gear is meshed with a toothed plate. The toothed plate is fixedly connected to a sidewall of the fixing plate.

Preferably, two sliding sleeves are fixedly connected to the top of the fixing plate, and the two sliding sleeves are configured to slide on two sidewalls of a fixing frame, respectively. The fixing frame is fixedly connected to the inner side of the fixing bracket.

Preferably, the Y-direction adjusting assembly includes a second drive motor fixedly connected to the bottom of the fixing plate. One end of a linear lead screw is fixedly connected to an output shaft of the second drive motor, and the other end of the linear lead screw is rotatably connected to the bottom of the fixing plate. A movable piece is connected to an outer wall of the linear lead screw in a screw drive manner. Two ends of the movable piece are configured to slide on guide rods, respectively, and the two guide rods are fixedly connected to the bottom of the fixing plate.

Preferably, the Z-direction adjusting assembly includes a connecting frame fixedly connected to the bottom of the movable piece. An electric push rod is fixedly connected to the inner top of the connecting frame. A telescopic shaft of the electric push rod is fixedly connected to a movable sleeve. The movable sleeve is configured to slide on the connecting frame, and the movable sleeve is fixedly connected to a sidewall of the connecting plate.

Preferably, the spacing adjusting mechanism includes a double-shaft motor embedded into and fixedly connected to the connecting plate. One end of each of two adjusting lead screws is fixedly connected to each of two output shafts of the double-shaft motor, and the other end of each of the two adjusting lead screws is rotatably connected into the connecting plate. Adjusting pieces are connected to the outer walls of the two adjusting lead screws in a screw drive manner, respectively, and the two adjusting pieces are configured to slide on two adjusting grooves formed in the sidewall of the connecting plate, respectively.

Preferably, the flexible connection mechanism for damping includes two connecting pieces. One connecting piece has an end fixedly connected to a sidewall of the adjusting piece. The opposite ends of the two connecting pieces are fixedly connected to the outer walls of two ball seats, respectively. Movable balls are movable in the ball seats, and each of the two movable balls is fixedly connected to one end of each of two movable columns. A plurality of bent first damping springs are elastically fixedly connected to the ball seat and an outer wall of the movable column, and the plurality of first damping springs are annularly spaced at an equal distance. The two movable columns are movably connected to the outer walls of two ends of a connecting column. Movable pieces are fixedly connected to the two ends of the connecting column, respectively, and the two movable pieces are slidably arranged in movement cavities formed in the two movable columns, respectively. Fixing rings are fixedly connected to the outer walls of the two movable columns. A second damping spring is elastically fixedly connected between the two fixing rings.

Preferably, the clamping claw mechanism includes a third drive motor fixedly connected to an outer wall of the other connecting piece. A second gear is fixedly connected to an output shaft of the third drive motor, and the second gear is meshed with a gear ring. The gear ring is fixedly connected to an outer wall of a rotating ring, and the rotating ring is rotatably connected to the outer wall of the other connecting piece. Articulated pieces symmetrical to each other are fixedly connected to an outer wall of the rotating ring, and the two articulated pieces are articulated with two protrusions through two articulated rods. The two protrusions are fixedly connected to the sidewalls of two clamping claws, respectively. The moving ends of the two clamping claws are movable in a sleeve plate, and the clamping ends of the two clamping claws are semicircular. The sleeve plate is fixedly connected to one end of the other connecting piece.

Preferably, one sidewall of the sleeve plate is provided with two first movement holes, and the other sidewall of the sleeve plate is provided with a second movement hole.

Preferably, the clamping claw mechanism is used in coordination with a connecting seat fixedly arranged on a sidewall of a ship body.

Compared with the prior art, the automatic berthing system for an unmanned ship of the present disclosure at least has the following beneficial effects.

(1) By the arrangement of the position adjusting mechanism, an unmanned ship does not need to have a high-accuracy berthing function and only needs to automatically move to be within the range of the roof plate. The position of the clamping claw mechanism can be automatically adjusted to be connected to the connecting seat on the sidewall of the ship body. Then, the unmanned ship can be automatically towed to the roof plate, thereby fulfilling the accurate berthing function. Furthermore, the unmanned ship is unlikely to directly collide with the shore during berthing, achieving an excellent berthing effect. Through the protection of the roof plate on the unmanned ship, high-end sophisticated electronics of the unmanned ship are unlikely to be eroded by rain or maliciously damaged by other people, achieving high safety.

(2) By the arrangement of the spacing adjusting mechanism, the spacing between two clamping claw mechanisms is adjusted according to the spacing between two connecting seats on the sidewall of the ship body, such that the two clamping claw mechanisms can be smoothly connected to the connecting seats. The present disclosure can be applied to various ship bodies with different spacings of the connecting seats.

(3) By the arrangement of the flexible connection mechanism, under the action of the first damping spring and the second damping spring, the floating strength of the unmanned ship is greatly reduced, and the impact force of the waves on the unmanned ship in different directions is reduced, such that flexible berthing of the ship body is realized and the unmanned ship can float within a safe range without colliding with the shore and the roof plate. Besides, multiple unmanned ships are unlikely to collide with one another after berthing, such that the service life of the unmanned ships is prolonged. Thus, the multiple unmanned ships can berth together, achieving higher efficiency.

In conclusion, the present disclosure can realize accurate berthing of an unmanned ship, achieve an excellent berthing effect, and provide protection for the unmanned ship, achieving high safety. The present disclosure can be widely applied to ship bodies with different spacings of the connecting seats and can reduce the impact force of waves on the unmanned ship in different directions, realizing flexible berthing of the ship body and ensuring the ship floats within a safe range from other ships to avoid a collision. Besides, multiple unmanned ships can berth together, achieving higher efficiency.

Figure 1:
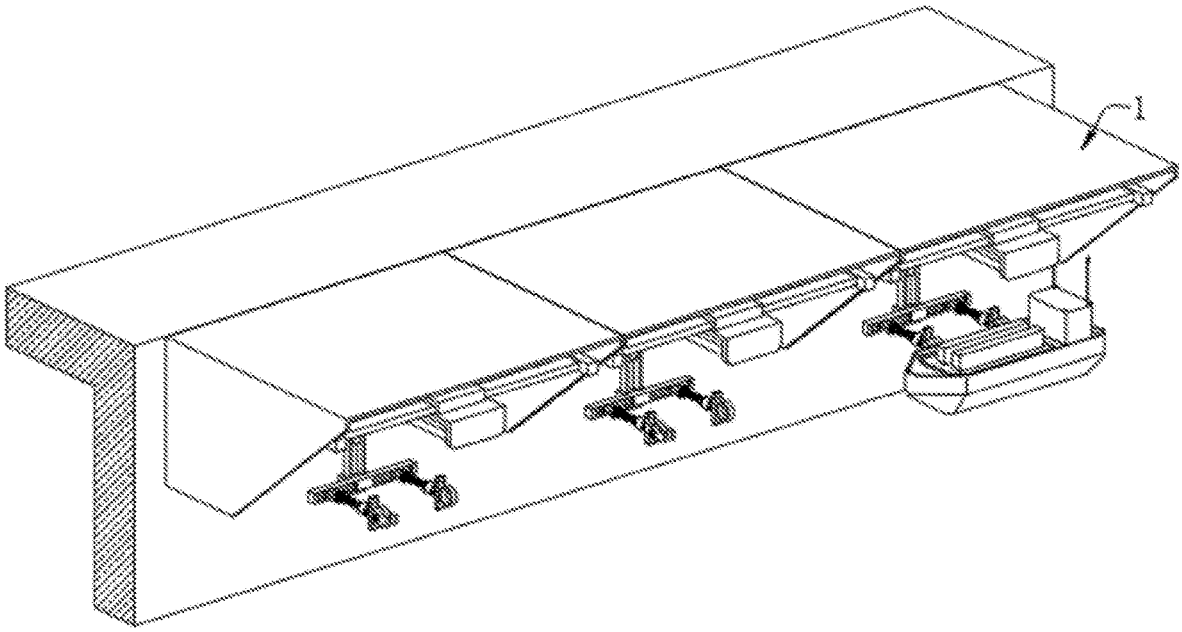
FIG. 1 is a schematic view of the overall structure of the present disclosure.

Reference numerals: 1. roof plate, 2. position adjusting mechanism, 21. fixing bracket, 22. X-direction adjusting assembly, 221. first drive motor, 222. first gear, 223. toothed plate, 23. fixing plate, 24. sliding sleeve, 25. fixing frame, 26. Y-direction adjusting assembly, 261. second drive motor, 262. linear lead screw, 263. movable piece, 264. guide rod, 27. Z-direction adjusting assembly, 271. connecting frame, 272. electric push rod, 273. movable sleeve, 3. connecting plate, 4. spacing adjusting mechanism, 41. double-shaft motor, 42. adjusting lead screw, 43. adjusting piece, 5. flexible connection mechanism for damping, 51. connecting piece, 52. ball seat, 53. movable ball, 54. movable column, 55. first damping spring, 56. connecting column, 57. movable piece, 58. fixing ring, 59. second damping spring, 6. clamping claw mechanism, 61. third drive motor, 62. second gear, 63. gear ring, 64. rotating ring, 65. articulated piece, 66. articulated rod, 67. protrusion, 68. clamping claw, 69. sleeve plate, 6901. first movement hole, 6902. second movement hole, 7. connecting seat, 8. ship body.

DETAILED DESCRIPTION OF THE EMBODIMENTS

The present disclosure is further described below with reference to the embodiments.

The following embodiments are intended to illustrate the present disclosure, rather than to limit the scope of protection of the present disclosure. Conditions in the embodiments can be further adjusted according to actual conditions, and simple improvements to the method of the present disclosure under the premise of the concept of the present disclosure all fall within the scope of protection of the present disclosure.

Figure 2:
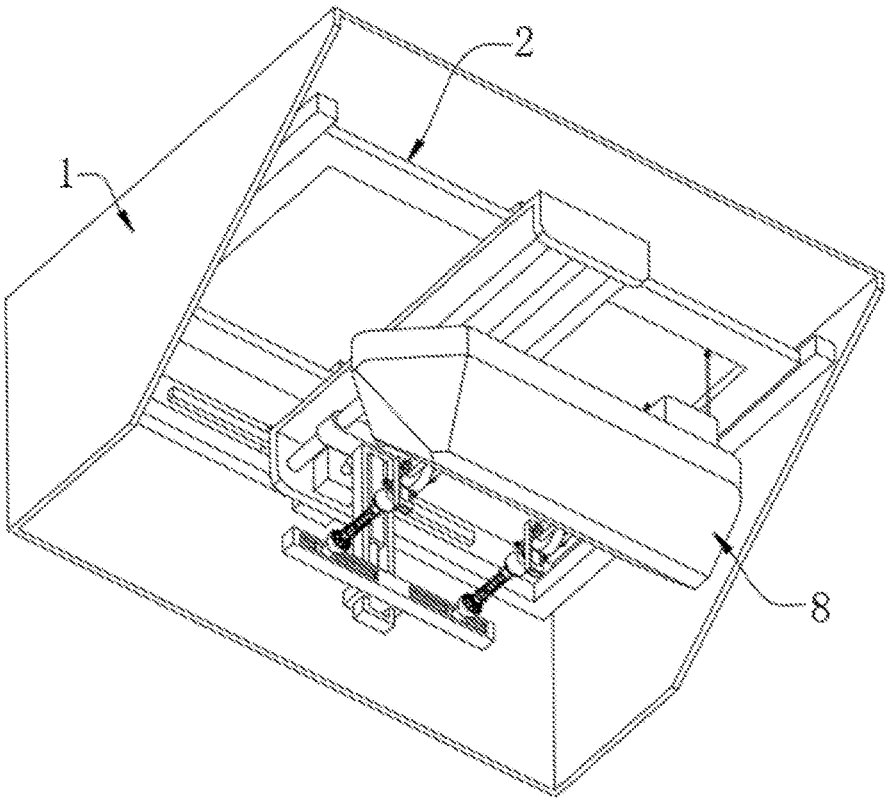
FIG. 2 is a schematic view of an internal structure of a single roof plate of the present disclosure.
Figure 3:
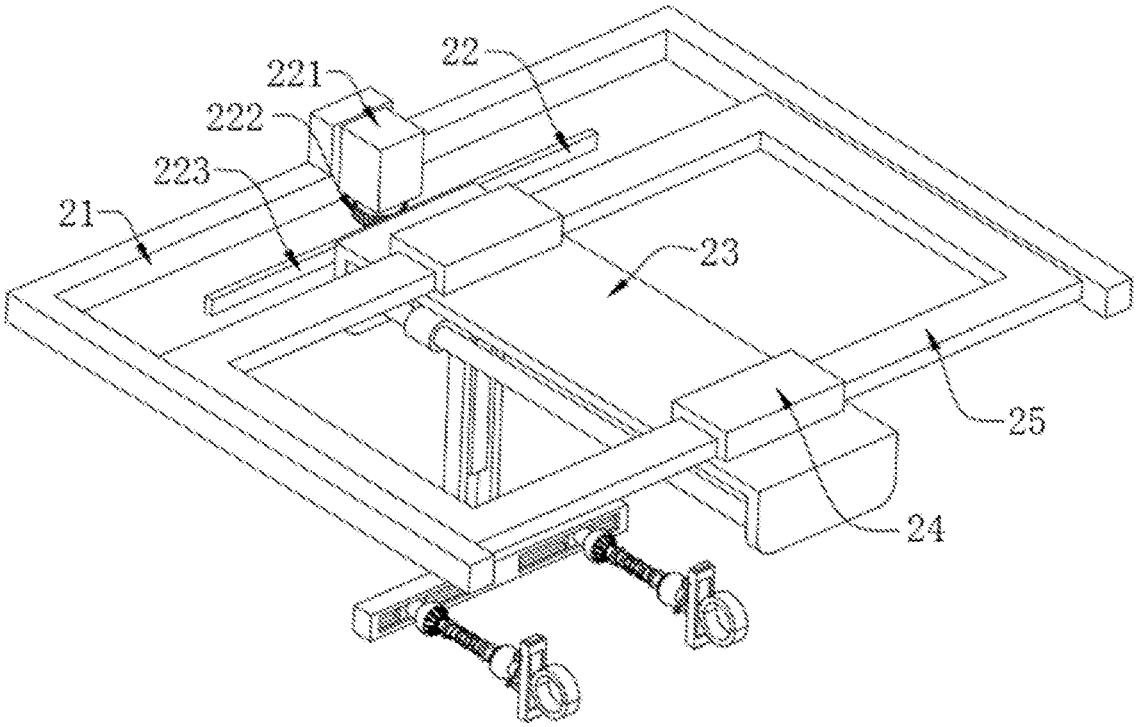
FIG. 3 is a structural view illustrating the joints of an X-direction adjusting assembly of the present disclosure.
Figure 4:
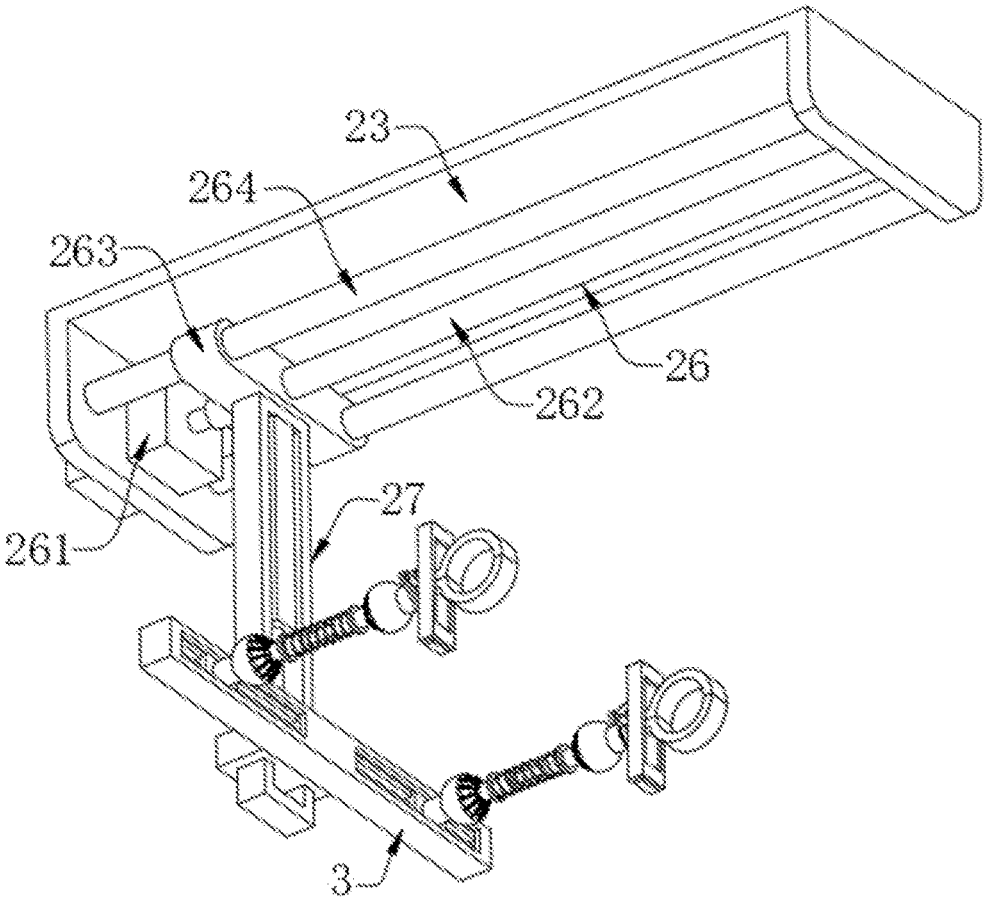
FIG. 4 is a structural view of the joints of a Y-direction adjusting assembly of the present disclosure.
Figure 5:
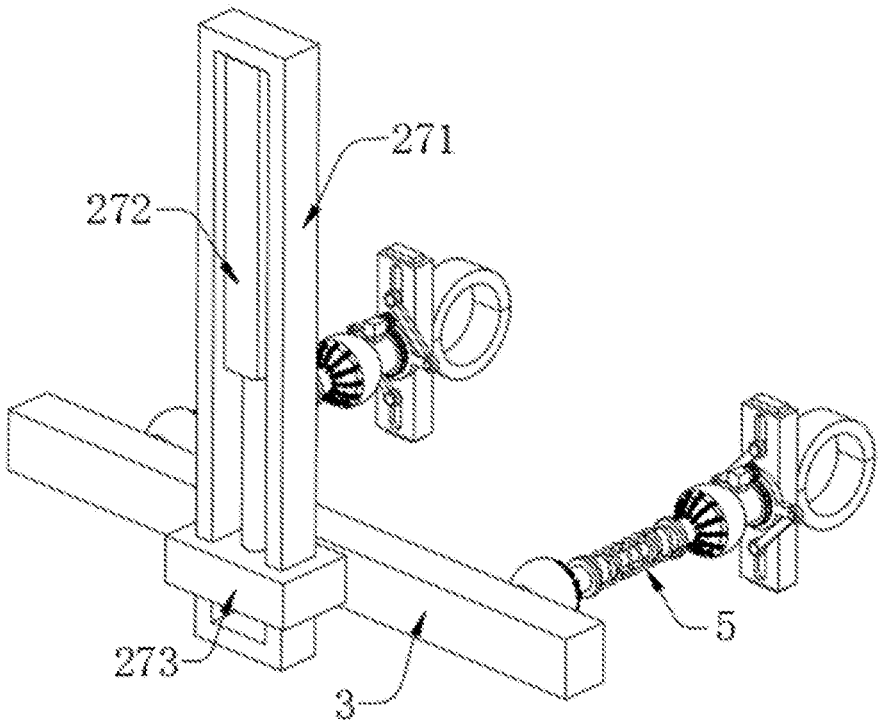
FIG. 5 is a structural view of the joints of a Z-direction adjusting assembly of the present disclosure.
Figure 6:
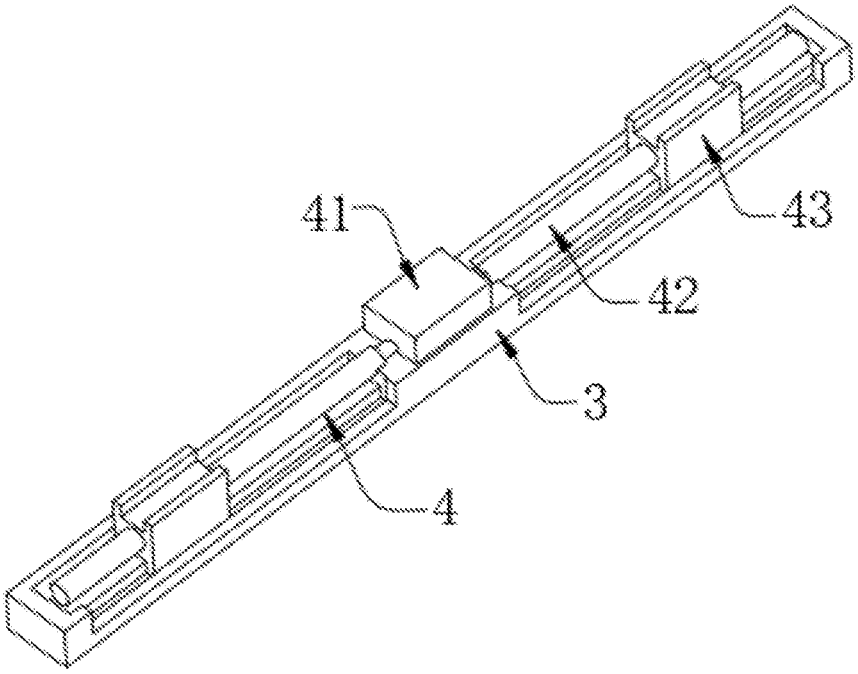
FIG. 6 is a sectional structural view of a connecting plate of the present disclosure.
Figure 7:
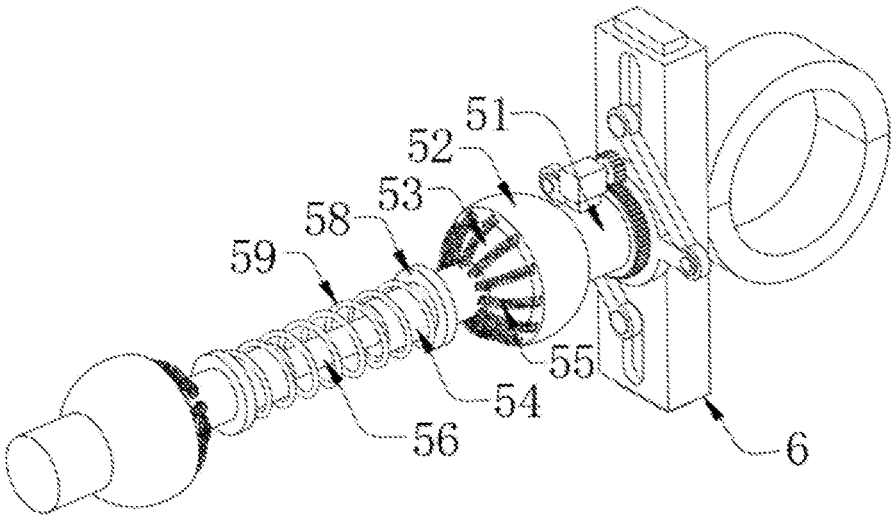
FIG. 7 is a structural view of the joints of a flexible connection mechanism for damping of the present disclosure.
Figure 8:
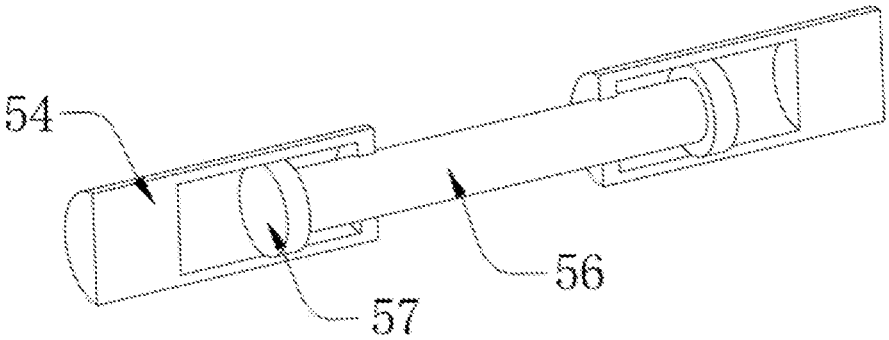
FIG. 8 is a sectional structural view of the joints of the two movable columns of the present disclosure.
Figure 9:
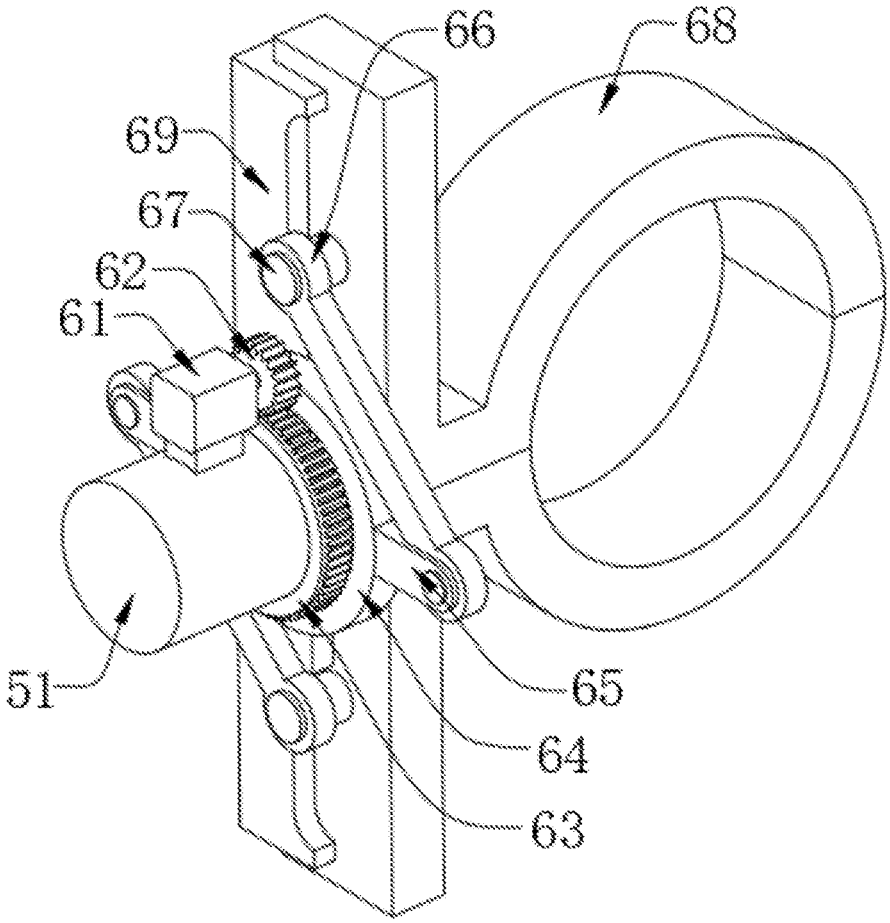
FIG. 9 is a structural view of a clamping claw mechanism of the present disclosure.
Figure 10:
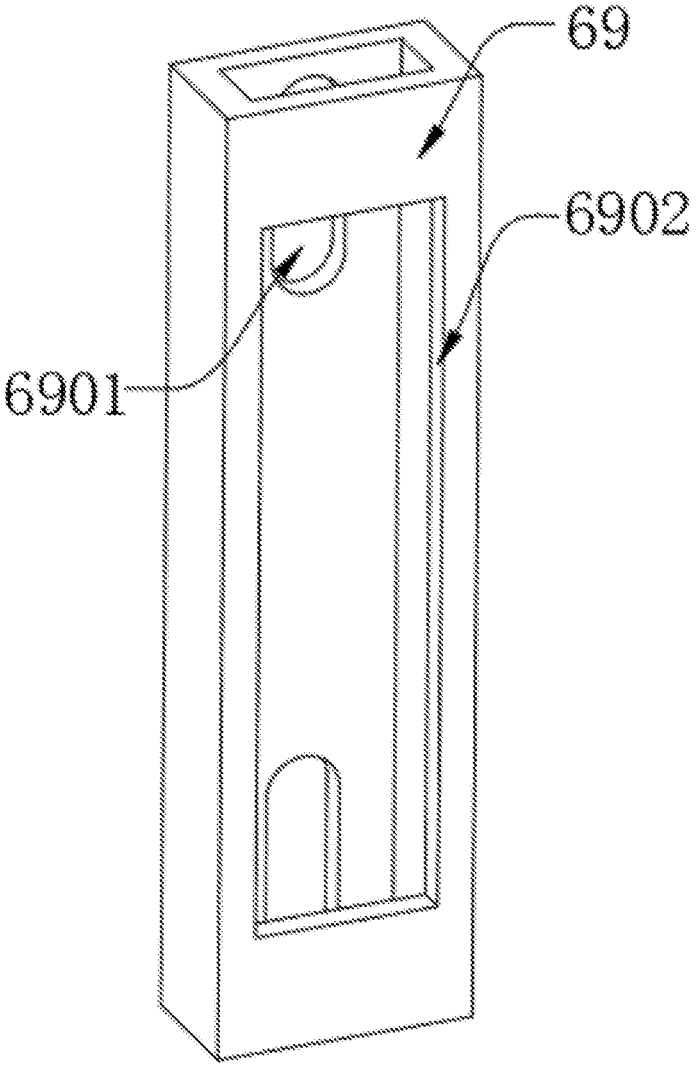
FIG. 10 is a structural view of a sleeve plate of the present disclosure.
Figure 11:
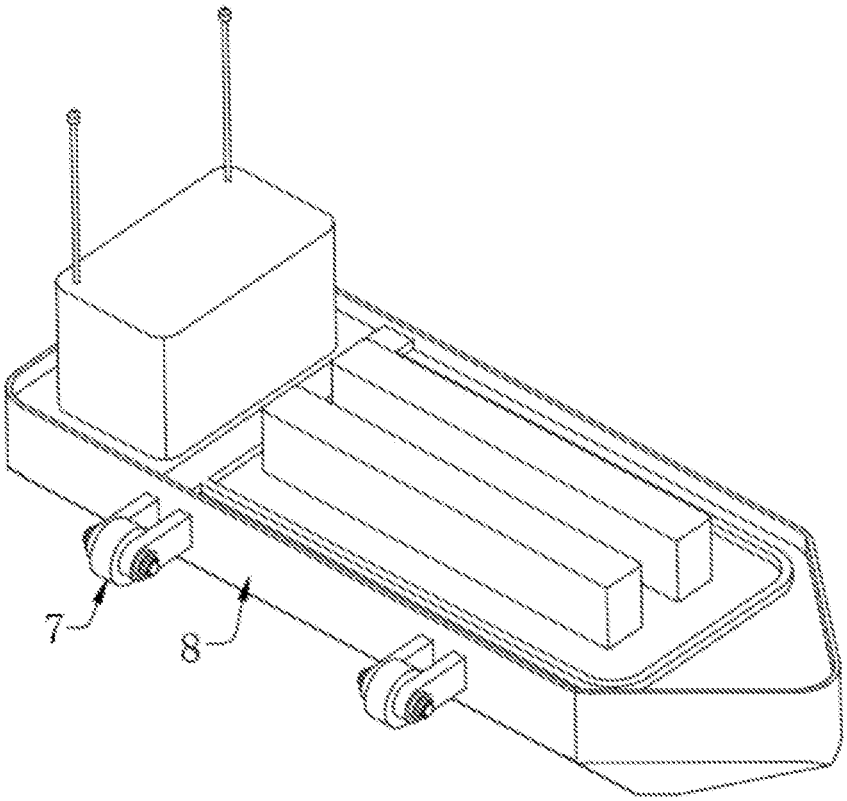
FIG. 11 is a structural view of a ship body of the present disclosure.

Referring to FIG. 1 to FIG. 11, an automatic berthing system for an unmanned ship of the present disclosure includes a plurality of roof plates 1 fixedly arranged at a side edge of a shore, and position adjusting mechanism 2 is fixedly arranged in the roof plate 1. The position adjusting mechanism 2 includes X-direction adjusting assembly 22, Y-direction adjusting assembly 26, and Z-direction adjusting assembly 27, where the X-direction adjusting assembly 22 is fixedly connected to an inner sidewall of fixing bracket 21. The fixing bracket 21 is fixedly connected to an inner sidewall of the roof plate 1. Fixing plate 23 is connected to the inner side of the X-direction adjusting assembly 22. The Y-direction adjusting assembly 26 is connected to the bottom of the fixing plate 23. The Z-direction adjusting assembly 27 is connected to the bottom of the Y-direction adjusting assembly 26. Connecting plate 3 is fixedly connected to the bottom of the Z-direction adjusting assembly 27. Spacing adjusting mechanism 4 is arranged on the inner side of the connecting plate 3. Two flexible connection mechanisms 5 for damping are connected to the spacing adjusting mechanism 4. Clamping claw mechanism 6 is fixedly connected to an end, away from the connecting plate 3, of each of the two flexible connection mechanisms 5 for damping.

Further, the X-direction adjusting assembly 22 includes first drive motor 221 fixedly connected to the inner sidewall of the fixing bracket 21. First gear 222 is fixedly connected to an output shaft of the first drive motor 221, and first gear 222 is meshed with toothed plate 223. The toothed plate 223 is fixedly connected to a sidewall of the fixing plate 23. The X-direction adjusting assembly 22 is used to adjust the horizontal position of the clamping claw mechanism 6 according to the position of ship body 8.

Further, two sliding sleeves 24 are fixedly connected to the top of the fixing plate 23, and the two sliding sleeves 24 are configured to slide on two sidewalls of fixing frame 25, respectively. The fixing frame 25 is fixedly connected to the inner side of the fixing bracket 21, such that the fixing plate 23 is kept more stable when horizontally adjusted.

Further, the Y-direction adjusting assembly 26 includes second drive motor 261 fixedly connected to the bottom of the fixing plate 23. One end of linear lead screw 262 is fixedly connected to an output shaft of the second drive motor 261, and the other end of the linear lead screw 262 is rotatably connected to the bottom of the fixing plate 23. Movable piece 263 is connected to an outer wall of the linear lead screw 262 in a screw drive manner. Two ends of the movable piece 263 are configured to slide on guide rods 264, respectively, and the two guide rods 264 are fixedly connected to the bottom of the fixing plate 23. The Y-direction adjusting assembly 26 is used to drive the clamping claw mechanisms 6 to move toward connecting seat 7 on a sidewall of the ship body 8.

Further, the Z-direction adjusting assembly 27 includes connecting frame 271 fixedly connected to the bottom of the movable piece 263. Electric push rod 272 is fixedly connected to the inner top of the connecting frame 271. A telescopic shaft of the electric push rod 272 is fixedly connected to the movable sleeve 273. The movable sleeve 273 is configured to slide on the connecting frame 271, and the movable sleeve 273 is fixedly connected to a sidewall of the connecting plate 3. The Z-direction adjusting assembly 27 is used to adjust the height position of the clamping claw mechanism 6 according to the day's water level height.

Further, the spacing adjusting mechanism 4 includes double-shaft motor 41 embedded into and fixedly connected to the connecting plate 3. One end of each of two adjusting lead screws 42 is fixedly connected to each of two output shafts of the double-shaft motor 41, and the other end of each of the two adjusting lead screws 42 is rotatably connected into the connecting plate 3. Adjusting pieces 43 are connected to the outer walls of the two adjusting lead screws 42 in a screw drive manner, respectively, and the two adjusting pieces 43 are configured to slide on two adjusting grooves formed in the sidewall of the connecting plate 3, respectively. The spacing adjusting mechanism 4 is used to adjust the spacing between the two clamping claw mechanisms 6 according to the spacing between the two connecting seats 7 on the sidewall of the ship body 8 to ensure that the two clamping claw mechanisms 6 can be smoothly connected to the two connecting seats 7. Various ship bodies 8 with different spacings of the connecting seats 7 are adapted, achieving a wide application range.

Further, the flexible connection mechanism 5 for damping includes two connecting pieces 51. One connecting piece 51 has an end fixedly connected to a sidewall of the adjusting piece 43. The opposite ends of the two connecting pieces 51 are fixedly connected to the outer walls of two ball seats 52, respectively. Movable balls 53 are movable in the ball seats 52, and each of the two movable balls 53 is fixedly connected to one end of each of two movable columns 54. A plurality of bent first damping springs 55 are elastically fixedly connected to the ball seat 52 and an outer wall of the movable column 54, and the plurality of first damping springs 55 are annularly spaced at an equal distance. The two movable columns 54 are movably connected to the outer walls of the two ends of connecting column 56. Movable pieces 57 are fixedly connected to the two ends of the connecting column 56, respectively, and the two movable pieces 57 are slidably arranged in movement cavities formed in the two movable columns 54, respectively. Fixing rings 58 are fixedly connected to the outer walls of the two movable columns 54. Second damping spring 59 is elastically fixedly connected between the two fixing rings 58. Under the action of the first damping springs 55 and the second damping spring 59, the floating strength of an unmanned ship is greatly reduced, and the impact force of waves on the unmanned ship in different directions is reduced, such that the unmanned ship can float within a safe range without colliding with the shore and the roof plate 1. Besides, multiple unmanned ships are unlikely to collide with one another after berthing, such that the service life of the unmanned ships is prolonged.

Further, the clamping claw mechanism 6 includes third drive motor 61 fixedly connected to an outer wall of the other connecting piece 51. Second gear 62 is fixedly connected to an output shaft of the third drive motor 61, and the second gear 62 is meshed with gear ring 63. The gear ring 63 is fixedly connected to an outer wall of rotating ring 64, and the rotating ring 64 is rotatably connected to the outer wall of the other connecting piece 51. Articulated pieces 65 symmetrical to each other are fixedly connected to an outer wall of the rotating ring 64, and the two articulated pieces 65 are articulated with two protrusions 67 through two articulated rods 66. The two protrusions 67 are fixedly connected to the sidewalls of two clamping claws 68, respectively. The moving ends of the two clamping claws 68 are movable in sleeve plate 69, and the clamping ends of the two clamping claws 68 are semicircular. The sleeve plate 69 is fixedly connected to one end of the other connecting piece 51. The clamping claw mechanism 6 is used to connect to the ship body 8.

Further, one sidewall of the sleeve plate 69 is provided with two first movement holes 6901, and the other sidewall of the sleeve plate 69 is provided with second movement hole 6902, such that movements of the protrusions 67 and the clamping claws 68 are facilitated.

Further, the clamping claw mechanism 6 is used in coordination with the connecting seat 7 fixedly arranged on the sidewall of the ship body 8 to connect to the ship body 8.

When in use, the unmanned ship moves to the roof plate 1 on the shore on its power and keeps still. At this time, by the arrangement of the position adjusting mechanism 2, the first drive motor 221 of the X-direction adjusting assembly 22 is started first to drive the first gear 222 to rotate, and the first gear 222 drives, under a meshing effect of the first gear 222 and the toothed plate 223, the fixing plate 23 to move left and right to adjust the horizontal position of the clamping claw mechanism 6 according to the position of the ship body 8. Then the electric push rod 272 of the Z-direction adjusting assembly 27 is started to drive the movable sleeve 273 to move up and down to adjust the height position of the clamping claw mechanism 6 according to the water level height on the current date. Finally, the second drive motor 261 of the Y-direction adjusting assembly 26 is started to drive the linear lead screw 262 to rotate, and the linear lead screw 262 drives, under a screw drive effect of the linear lead screw 262 and the movable piece 263, the clamping claw mechanism 6 to move toward the connecting seat 7 on the sidewall of the ship body 8. Then, by the arrangement of the spacing adjusting mechanism 4, the double-shaft motor 41 is started to operate and drive the two adjusting lead screws 42 to rotate, and the adjusting lead screws 42 enable, under a screw drive effect of the adjusting lead screws 42 and the adjusting pieces 43, the two clamping claw mechanisms 6 to get close to or away from each other. Thus, the spacing between the two clamping claw mechanisms 6 is adjusted according to the spacing between the two connecting seats 7 on the sidewall of the ship body, such that the two clamping claw mechanisms 6 can be smoothly connected to the connecting seats 7. When the clamping claw mechanism 6 moves to the connecting seat 7 after the spacing between the clamping claw mechanisms 6 is adjusted, the third drive motor 61 of the clamping claw mechanism 6 is started to operate and drive the second gear 62 to rotate. The second gear 62 drives, under a meshing effect of the second gear 62 and the gear ring 63, the rotating ring 64 to rotate. The rotating ring 64 enables the two clamping claw mechanisms 6 to get close to each other under an articulated effect of the articulated piece 65, the articulated rod 66, and the protrusion 67. The unmanned ship is fixed under a clamping connection effect of the claw mechanism 6 and the connecting seat 7. Finally, the X-direction adjusting assembly 22 and the Y-direction adjusting assembly 26 are reset. In this way, the unmanned ship can be automatically towed to the roof plate 1, such that more accurate berthing is fulfilled. Furthermore, the unmanned ship is unlikely to directly collide with the shore during the berthing, achieving an excellent berthing effect. Through the protection of the roof plate 1 on the unmanned ship, high-end sophisticated electronics of the unmanned ship are unlikely to be eroded by rain or maliciously damaged by other people, achieving high safety. After berthing, the unmanned ship floats up and down, left and right, back and forth, or in all the above ways under the impact of waves. By the arrangement of the flexible connection mechanism 5, during the floating of the unmanned ship, the ball seat 52 and the movable ball 53 rotate relative to each other by corresponding displacements, and the two movable columns 54 and the connecting column 56 are retracted relative to each other. Meanwhile, under the action of the first damping spring 55 and the second damping spring 59, the floating strength of the unmanned ship is greatly reduced, and the impact force of the waves on the unmanned ship in different directions is reduced, such that the unmanned ship can float within a safe range without colliding with the shore and the roof plate 1. Besides, multiple unmanned ships are unlikely to collide with one another after berthing, such that the service life of the unmanned ships is prolonged. Thus, multiple unmanned ships can berth together, achieving higher efficiency.

Although the embodiments of the present disclosure have been illustrated and described, it should be understood that those of ordinary skill in the art can make various changes, modifications, replacements, and variations to the above embodiments without departing from the principle and spirit of the present disclosure, and the scope of the present disclosure is limited by the appended claims and their equivalents.

What is claimed is:

1. An automatic berthing system for an unmanned ship comprising a plurality of roof plates fixedly arranged at a side edge of a shore, wherein a position adjusting mechanism is fixedly arranged in the roof plate; the position adjusting mechanism comprises an X-direction adjusting assembly, a Y-direction adjusting assembly, and a Z-direction adjusting assembly; the X-direction adjusting assembly is fixedly connected to an inner sidewall of a fixing bracket; the fixing bracket is fixedly connected to an inner sidewall of the roof plate; a fixing plate is connected to an inner side of the X-direction adjusting assembly; the Y-direction adjusting assembly is connected to a bottom of the fixing plate; the Z-direction adjusting assembly is connected to a bottom of the Y-direction adjusting assembly; a connecting plate is fixedly connected to a bottom of the Z-direction adjusting assembly; a spacing adjusting mechanism is arranged on an inner side of the connecting plate; two flexible connection mechanisms for damping are connected to the spacing adjusting mechanism; and a clamping claw mechanism is fixedly connected to an end, away from the connecting plate, of each of the two flexible connection mechanisms for damping.

2. The automatic berthing system for the unmanned ship according to claim 1, wherein the X-direction adjusting assembly comprises a first drive motor fixedly connected to the inner sidewall of the fixing bracket; wherein a first gear is fixedly connected to an output shaft of the first drive motor, and the first gear is meshed with a toothed plate; and the toothed plate is fixedly connected to a sidewall of the fixing plate.

3. The automatic berthing system for the unmanned ship according to claim 1, wherein two sliding sleeves are fixedly connected to a top of the fixing plate, and the two sliding sleeves are configured to slide on two sidewalls of a fixing frame, respectively; and the fixing frame is fixedly connected to an inner side of the fixing bracket.

4. The automatic berthing system for the unmanned ship according to claim 1, wherein the Y-direction adjusting assembly comprises a second drive motor fixedly connected to the bottom of the fixing plate; wherein one end of a linear lead screw is fixedly connected to an output shaft of the second drive motor, and the other end of the linear lead screw is rotatably connected to the bottom of the fixing plate; a movable piece is connected to an outer wall of the linear lead screw in a screw drive manner; and two ends of the movable piece are configured to slide on guide rods, respectively, and the two guide rods are fixedly connected to the bottom of the fixing plate.

5. The automatic berthing system for the unmanned ship according to claim 4, wherein the Z-direction adjusting assembly comprises a connecting frame fixedly connected to a bottom of the movable piece; wherein an electric push rod is fixedly connected to an inner top of the connecting frame; a telescopic shaft of the electric push rod is fixedly connected to a movable sleeve; and the movable sleeve is configured to slide on the connecting frame, and the movable sleeve is fixedly connected to a sidewall of the connecting plate.

6. The automatic berthing system for the unmanned ship according to claim 1, wherein the spacing adjusting mechanism comprises a double-shaft motor embedded into and fixedly connected to the connecting plate; wherein one end of each of two adjusting lead screws is fixedly connected to each of two output shafts of the double-shaft motor, and the other end of each of the two adjusting lead screws is rotatably connected into the connecting plate; and adjusting pieces are connected to outer walls of the two adjusting lead screws in a screw drive manner, respectively, and the two adjusting pieces are configured to slide on two adjusting grooves formed in a sidewall of the connecting plate, respectively.

7. The automatic berthing system for the unmanned ship according to claim 6, wherein the flexible connection mechanism for damping comprises two connecting pieces; wherein one connecting piece has an end fixedly connected to a sidewall of the adjusting piece; opposite ends of the two connecting pieces are fixedly connected to outer walls of two ball seats, respectively; movable balls are movable in the ball seats, and each of the two movable balls is fixedly connected to one end of each of two movable columns; a plurality of bent first damping springs are elastically fixedly connected to the ball seat and an outer wall of the movable column, and the plurality of bent first damping springs are annularly spaced at an equal distance; the two movable columns are movably connected to outer walls of two ends of a connecting column; movable pieces are fixedly connected to the two ends of the connecting column, respectively, and the two movable pieces are slidably arranged in movement cavities formed in the two movable columns, respectively; fixing rings are fixedly connected to outer walls of the two movable columns; and a second damping spring is elastically fixedly connected between the two fixing rings.

8. The automatic berthing system for the unmanned ship according to claim 7, wherein the clamping claw mechanism comprises a third drive motor fixedly connected to an outer wall of the other connecting piece; wherein a second gear is fixedly connected to an output shaft of the third drive motor, and the second gear is meshed with a gear ring; the gear ring is fixedly connected to an outer wall of a rotating ring, and the rotating ring is rotatably connected to the outer wall of the other connecting piece; articulated pieces symmetrical to each other are fixedly connected to an outer wall of the rotating ring, and the two articulated pieces are articulated with two protrusions through two articulated rods; the two protrusions are fixedly connected to sidewalls of two clamping claws, respectively; moving ends of the two clamping claws are movable in a sleeve plate, and clamping ends of the two clamping claws are semicircular; and the sleeve plate is fixedly connected to one end of the other connecting piece.

9. The automatic berthing system for the unmanned ship according to claim 8, wherein one sidewall of the sleeve plate is provided with two first movement holes, and the other sidewall of the sleeve plate is provided with a second movement hole.

10. The automatic berthing system for the unmanned ship according to claim 1, wherein the clamping claw mechanism is used in coordination with a connecting seat fixedly arranged on a sidewall of a ship body.

* * * * *